United States Patent [19]

Eichweber

[11] 4,222,632

[45] Sep. 16, 1980

[54] LIGHT RECEIVING AND REFLECTING DEVICE

[76] Inventor: Kurt Eichweber, Holsteiner, Chaussee 379/381, 2000 Hamburg 61, Fed. Rep. of Germany

[21] Appl. No.: 952,235

[22] Filed: Oct. 17, 1978

[30] Foreign Application Priority Data

Oct. 18, 1977 [DE] Fed. Rep. of Germany ..... 2746800

[51] Int. Cl.[3] ..... H04B 9/00

[52] U.S. Cl. ..... 350/102; 350/96.10

[58] Field of Search ..... 350/96.18, 96.10, 102; 250/227

[56] References Cited

U.S. PATENT DOCUMENTS

| | | | |
|---|---|---|---|
| 3,456,211 | 7/1969 | Koester | 350/96.18 X |
| 4,096,380 | 6/1978 | Eichweber | 350/102 X |
| 4,148,558 | 4/1979 | Schuck | 350/96.18 X |

FOREIGN PATENT DOCUMENTS

| | | |
|---|---|---|
| 1261019 | 12/1964 | Fed. Rep. of Germany . |
| 2148157 | 9/1971 | Fed. Rep. of Germany . |

*Primary Examiner*—David C. Nelms
*Assistant Examiner*—Darwin R. Hostetter
*Attorney, Agent, or Firm*—Arnold, White & Durkee

[57] ABSTRACT

A device for receiving and reflecting light beams includes a central processing unit for analyzing a first portion of a received light beam, at least one reception unit for receiving the light beam and reflecting a second portion of the light beam, and an optical conductor disposed between each reception unit and the central processing unit for transmitting the first portion of the received beam to the central processing unit. An optical element is positioned between the reception unit and the optical conductor for converging the light transmitted through the conductor. The central processing unit may also include a directional scanner which will calculate the direction of travel of the incident light beam. The device may also include at least one light source which is adapted to emit an optical response signal. A retroreflector is provided within each reception unit and is adapted to reflect the second portion of the incident light beam in a direction parallel and opposite to the direction of the incident beam.

7 Claims, 3 Drawing Figures

LIGHT RECEIVING AND REFLECTING DEVICE

BACKGROUND OF THE INVENTION

This invention relates to devices for receiving and reflecting light, particularly for the purposes of simulating the use of weaponry. In the device, a number of light reception units, which are distributed spatially, and a central processing unit, which is connected with the reception units by optical conductors, are mounted on a carrier, such as a vehicle.

Such a device is known as, for example, in German patent specification No. 1 261 019, and the optical technique is particularly applicable to a shot simulation system which utilizes laser beams, in order to ascertain whether a vehicle or a similar target, which is equipped with such a device, is successfully "hit" by a light beam which is adapted to simulate the trajectory of a projectile. A number of light reception units must be distributed over a spatial configuration in this technique, in order to provide an indication of light reception on the target vehicle at any spot or from any given direction.

In the devices which are known in the art, the light reception units consist of photoelectric sensitive cells, such as photocells or semiconductor elements, which are connected with a central processing unit by electrical conductors. In these designs, each of the sensing elements must be equipped with its own preamplifier and an associated power supply, in order that the system may effectively amplify the weak signals which are received before they are transmitted to the central unit for processing. Consequently, such conventional reception units are relatively large and bulky, the arrangement producing considerable problems in terms of accommodating and attaching the reception units on the target.

In the conventional design, the weight, the cost, and the susceptibility of the system to interference from electronic radiation and noise cause additional disadvantages. Such problems are present even in a relatively uncomplicated device, where the central unit consists only of a simple amplifier with an attached indicating instrument, as is known, for example, in German patent specification No. 1 261 019. If the central unit utilized is a more complicated device, such as one which is equipped to evaluate impulse coding in the received light signals, the disadvantages of the conventional systems are multiplied.

Furthermore, it is often desirable that the device be capable not only of receiving and evaluating incident light, but also of reflecting the incident light back towards the direction in which it was transmitted. In this manner, a laser beam simulating a shot may be utilized at the firing location to measure the distance to the target. Where this technique is required, it is known in the art to provide a retroreflector in the vicinity of each light reception unit. A retroreflector is a reflector having three planar reflecting surfaces mounted perpendicularly to each other. Such a reflector may be provided, for example, with a suitably shaped prism. When this reflecting capability is desired, an additional amount of cost, weight, etc. is introduced into the device, with consequent further requirements for attachment and connection to the system. Such an arrangement is known in the art as, for example, in German patent application No. 2 148 157. In these conventional arrangements, the light reception units are not connected to a central unit, but are each separately equipped with an amplifier and associated indicator devices.

SUMMARY OF THE INVENTION

The purpose of the present invention is to provide a light receiving and reflecting device which is considerably simpler in construction, lighter, cheaper, and more resistant to interference than such devices as are known in the prior art, as well as being capable of reflecting the incident light received.

The problems inherent in such previous designs are solved by using the light reception units as retroreflectors and by using optical conductors which are optically connected with the reflectors and which are attached to a sensory cell in the central unit. Because of this arrangement, only one optically passive element, i.e., the retroreflector, is required at each light reception unit in a device constructed according to the present invention. From the light reception unit, a portion of the received light is conducted directly along the optical conductor to the central processing unit. Preamplifiers, power supplies, sensory cells, etc. are not required at the light reception unit locations. Furthermore, the optical elements which are utilized are relatively cheap to manufacture, are lightweight and compact, and may be readily mass produced.

In the present invention, each optical conductor is connected to an associated retroreflector, preferably at the apex of the three planar reflecting surfaces. An optical element, such as a lens, may advantageously be provided at the connection between the optical conductor and the retroreflector, in order to converge and reinforce the light so that an intensification of the signal is achieved by a purely optical means. Such a lens may be provided, for example, in the form of a Luneberg lens. In the device of this invention it is a simple matter to connect each light reception unit directly with the central processing unit via an individual optical conductor, since such conductors are very thin, are easily produced, and may be installed without any special requirements as to insulation, shielding, etc. The optical conductors which connect with the central unit may be coupled either to individual sensory cells and amplifying devices or to a pickup unit which is equipped to determine the incident direction of the light. For example, a matrix-type or ring shaped arrangement of sensory cells, a quadrant detector, or the like, might be provided for purposes of sequential scanning. The optical conductors may also be connected with a light source and thereby used to transmit a responsive light signal.

BRIEF DESCRIPTION OF THE DRAWINGS

Additional objects, features, and advantages of the present invention will become apparent by referring to the following detailed description of the preferred embodiments in connection with the accompanying drawings, wherein like reference numerals refer to like elements throughout all the figures.

In the drawings.

DESCRIPTION OF THE PREFERRED EMBODIMENTS

Figure 1:
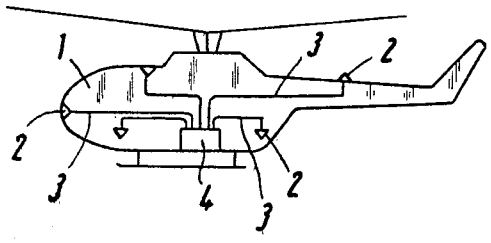
FIG. 1 is a schematic illustration showing a light receiving and reflecting device constructed according to the present invention mounted on a helicopter.

As shown in FIG. 1, a number of retroreflectors 2 are distributed over a helicopter. These reflectors are provided with three plane mirrors mounted at right angles to each other. The reflectors consequently will reflect incident light from any direction parallel to the incident light and in the opposite direction. Connected to each retroreflector 2 is an optical conductor 3, which transmits a small portion of the incident light to a central processing unit 4. Appropriate light reception and evaluation devices, as well as a common sensory device, are contained within the central unit 4.

Alternatively, a separate sensory cell may be provided for each optical light conductor. Preamplifiers and other equipement required for the evaluation of the electrical signals produced by the sensory cells are also located within the central unit. In addition to providing an indication of the receipt of light, the central unit may also process the information contained in an input light signal in the form of impulse coding. The light signals obtained from the optical conductors can also be scanned by quadrant detectors, matrix-type, or ring shaped arrangements of the sensory cells, or the like. The signals can thus be scanned in such a way that the incident direction of the light, as well as difference in travel time between different light reception units, may be evaluated.

Figure 2:
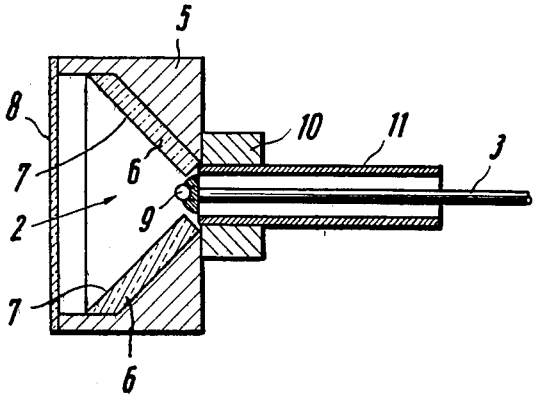
FIG. 2 is a longitudinal section through a light receiving unit of the device shown in FIG. 1.

As shown in FIG. 2, in one design the retroreflector 2 includes a mounting 5, in which three plane mirrors 6 are arranged in such a way that each one is fixed perpendicularly to the other two, in order to form the corner of a cube. The interior surfaces 7 of the mirror 6 are provided with reflective coatings, and the entire device is covered by a protective glass shield 8. The light conductor 3 is connected at the corner or apex formed by the mirrors 6. An appropriate coupling element may be provided to converge the highest possible amount of the incident light into the optical conductor 3. Such a coupling element may be provided, for example, in the form of a Luneberg lens 9, which is shown schematically. The optical conductor 3 is surrounded by a protective cover 11 which in turn is affixed to the mounting 5 by a collar 10.

Figure 3:
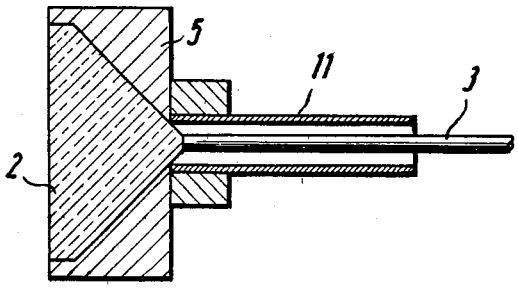
FIG. 3 is a longitudinal section through an alternative reception unit design for the device shown in FIG. 1.

Now referring to FIG. 3, an alternative design for the retroreflector includes a prism 2, which is manufactured with three inclined planes which are each provided with a mirrored surface. The prism is fixed in a mounting 5, and the optical conductor 3, which is surrounded by a protective cover 11, is connected at the corner or apex of the prism 2.

Either single strand or multistrand optical conductors 3 may be used. Such conductors are commercially available and need not be further described in this application.

Simpler light capturing elements, such as optical cone collectors, lenses, etc., may be used in place of the retroreflectors and connected with the optical conductors in a simplified arrangement, if reflection of the incident light beams is not required or need be only partial.

As will be recognized by those skilled in the art, the light receiving and reflecting device of this invention may be mounted not only on a helicopter but also on other vehicles, such as armored cars, ships, etc. Furthermore, other objects which are typical targets, either stationary or moving, may be equipped with such a light reception device. In particular, a person may be outfitted with such a device in order to utilize laser beams to simulate target practice directed toward humans. In the latter case, small and easily manufactured reflectors 2 and optical conductors 3 may be readily attached to an article of clothing to be worn by the person simulating the target.

Light sources, particularly lasers or laser diodes, may be attached to the same optical conductors, or to special optical conductors installed parallel to the primary optical conductors, where it is desirable to provide a responsive optical signal from the device. In this type of operation, the angle from which the optical conductor will receive light determines the diversion of the light beam which will be radiated from it. The distribution and alignment of the radiating optical conductors may be arranged so that any desired sector, or a full circle of coverage, may be achieved.

Although typical embodiments of the present invention have been illustrated and discussed herein, numerous modifications and alternative embodiments of the apparatus and method of this invention will be apparent to those skilled in the art in view of this description. Accordingly, this description is to be construed as illustrative only and is provided for the purpose of teaching those skilled in the art the manner of constructing the apparatus and performing the method of this invention. It is to be understood that the forms of the invention shown and described herein are to be considered as the presently preferred embodiments. Various changes may be made in the configurations, sizes, and arrangements of the parts of the invention, as will be recognized by those skilled in the art, without departing from the scope of the invention. For example, equivalent elements might be substituted for those illustrated and described herein, parts or connections might be reversed or otherwise interchanged, and certain features of the invention might be utilized independently of the use of other features, all as will be apparent to one skilled in the art after receiving the benefit attained through reading the foregoing description of the invention.

What is claimed is:

1. A device for receiving and detecting a light beam, comprising:

reception units for receiving said light beam, said reception units mounted at spatially distributed locations over the surface of a practice target;

a central processing unit for analyzing a first portion of said received light beam;

an optical conductor disposed between each reception unit and said central processing unit for transmitting said first portion of said received light beam to said central processing unit; and a retroreflector within each reception unit, said retroreflector being adapted to reflect a second portion of said received light beam in a direction parallel and opposite to the direction of said received light beam.

2. The device of claim 1, further comprising an optical element positioned between said reception unit and said optical conductor for converging the light transmitted through said conductor.

3. The device of claim 1, wherein said central processing unit further comprises a directional scanner, said scanner being adapted to calculate the incident direction of said received light beam.

4. The device of claim 1, further comprising at least one light source, said source being adapted to emit an optical signal from said device in response to the receipt of said light beam.

5. The device of claim 4, wherein said light sources comprise lasers.

6. The device of claim 1, wherein said retroreflector comprises:

a first planar reflecting surface;

a second planar reflecting surface perpendicular to said first surface; and a third planar reflecting surface perpendicular to said first and second surfaces.

7. The device of claim 1, wherein each optical conductor is operably connected to each reception unit at the apex of said retroreflector, said apex being defined as the point common to said first, second, and third planar reflecting surfaces.

* * * * *